US006047771A

United States Patent [19]

Røynestad

[11] Patent Number: 6,047,771

[45] Date of Patent: Apr. 11, 2000

[54] METHOD AND A DEVICE FOR HAULING A CASING OR THE LIKE UP FROM A BORE HOLE AND FOR INSERTING THE SAME DOWN TO A BORE HOLE

[76] Inventor: Tom Toralv Røynestad, Ovre Roynestad, N-4880 Kvinesdal, Norway

[21] Appl. No.: 09/051,853

[22] PCT Filed: Oct. 16, 1996

[86] PCT No.: PCT/NO96/00241

§ 371 Date: Apr. 22, 1998

§ 102(e) Date: Apr. 22, 1998

[87] PCT Pub. No.: WO97/14867

PCT Pub. Date: Apr. 24, 1997

[30] Foreign Application Priority Data

Oct. 20, 1995 [NO] Norway ..... 954195

[51] Int. Cl.[7] ..... E21B 19/16

[52] U.S. Cl. ..... 166/77.52; 166/77.1; 166/380; 166/377; 175/162

[58] Field of Search ..... 166/377, 379, 166/380, 77.1, 77.51, 85.1, 77.52; 175/85, 162, 220

[56] References Cited

U.S. PATENT DOCUMENTS

| | | | |
|---|---|---|---|
| 2,979,143 | 4/1961 | Kandle . | |
| 3,231,032 | 1/1966 | Genberg et al. . | |
| 3,390,730 | 7/1968 | Techy et al. . | |
| 4,582,146 | 4/1986 | Becker | 173/149 |
| 4,625,796 | 12/1986 | Boyadjieff | 166/77.52 |
| 4,765,401 | 8/1988 | Boyadjieff | 166/77.52 |
| 5,273,124 | 12/1993 | Lloyd et al. | 175/162 |

FOREIGN PATENT DOCUMENTS

| | | |
|---|---|---|
| 18 14 728 | 4/1976 | Germany . |
| 2924 392 C2 | 6/1979 | Germany . |
| 157988 | 6/1988 | Norway . |
| WO 90/02903 | 3/1990 | WIPO . |

*Primary Examiner*—William Neuder
*Assistant Examiner*—Zakiya Walker

[57] ABSTRACT

The invention relates to an additional equipment for a drilling rig (10) in order to enable hauling-up and lowering, respectively, of a pipe in a borehole. On the derrick (16) of the drilling rig (10), a lower carriage (34) for a catcher means (36) of the hauling-up device is disposed. The carriage (34) is displaceable up and down along the derrick (16). An upper carriage (30) carrying a drilling machine (24) is also displaceable up and down along the derrick (16). The carriage (34) of the hauling-up device is permanently interconnected to a driven transmission mechanism (48) providing up and downward movements along the derrick (16). During the drilling operations, the two carriages (30, 34) are interconnected. During the hauling-up/lowering operations, the two carriages (30, 34) are uncoupled from each other, and, then, the carriage (30) of the drilling machine (24) is coupled to the derick (16). Thus, the same transmission mechanism (48) is used both during the drilling operations and during the hauling-up/lowering operations.

5 Claims, 10 Drawing Sheets

METHOD AND A DEVICE FOR HAULING A CASING OR THE LIKE UP FROM A BORE HOLE AND FOR INSERTING THE SAME DOWN TO A BORE HOLE

FIELD OF THE INVENTION

The present invention relates to a method for hauling up especially casings or other objects placed within a cylindrical hole drilled in earth mass or rock. Also, the method may be used for inserting or pushing a pipe or other objects down into such a hole.

BACKGROUND OF THE INVENTION

Likewise, the invention relates to arrangements and improvements in drill rigs, generally comprising a derrick and a power source for rectilinear displacement of a working head or the like to and fro, e.g. a working head for connection of a drill string having a bit. Thus, the invention aims at utilizing such a prior art drill rig and assigns thereto extra equipment enabling the above-mentioned hauling, possibly insertion, of objects into the ground.

NO patent application No. 952813 deals with a method of piling in connection with drilled vertical or substantially vertical bore holes for receiving casings of the kind desired to be hauled up again and reused when the piling is finished. The present invention is not restricted to hauling up casings extending vertically in a driven down position, the invention also being associated with ashore drilling generally, and comprises hauling up casings in connection with deviation drilling.

As mentioned, NO patent application No. 952813 deals with a method of piling in connection to a preceding drilling operation carried out by means of a combined drilling/piling rig, and wherein, by means of a drilling means included as a working tool at the end of a drill string in a drilling rig, a vertical hole is drilled, and the piling can start from the bottom of this bore hole. A casing of the kind to be hauled up in accordance with the present invention, is releasably suspended from said drilling means by means of a reamer ring which, together with the casing, surrounds the bit, leaving a radial clearance, so that the casing is left standing on the lower end thereof at the bottom of the bore hole when the drill string is pulled up after terminated drilling.

When the piling is finished, it is desirable to have the casing hauled up for reuse. In accordance with the present invention, such casings are intended to be hauled up in an efficient way by means of a rational method, wherein the hauling device shares power source with the drilling machine in that respect that hauling device and drilling machine may use the same power source for reciprocating, rectilinear displacement movements. Downward insertion of drill string and hauling the same up are, thus, carried out through a common power source; this is also the case when lowering the catcher means of the hauling device in order to bring the former to grip and surround the upper end of the casing, and also upon hauling the same up, possibly followed by lowering the same into position. On the other hand, the rotation of the drill string/bit is based on the use of a separate power source, e.g. a hydraulic turning motor. In prior art technique, a separate rig or simlar machine has to be used for hauling up the casing.

From NO patent application No. 952813 it is previously known to dispose the drilling machine pivotally about a vertical axis at one vertical side of the drilling machine. Thus, the drilling machine may be swung laterally out of the vertical path from the upper end of the derrick down to the bottom of a predrilled hole. Such a pivotal capability is required in piling. Also, it is used a pipe narrower than the casing but surrounding the drill string. The annulus between said narrower pipe and the casing is made so narrow as possible in order to make more efficient the transport and removal of cuttings and to reduce the requirement for the air compressor's capacity. Said narrower pipe is brought to follow the drill string up and out of the bore hole, the casing—as mentioned—being left behind standing on the bore hole bottom.

SUMMARY OF THE INVENTION

According to the present invention, catcher means is disposed such that it has a first position, wherein it is widened in order to surround a casing lowered into the earth, around the upper end thereof, and a second position, wherein it is narrowed in order to secure a reliable grip around the upper end portion of the casing. In connection with elongated objects having a round cross-section and driven down into the earth, such a catcher means will have the form of a divided, substantially circular ring comprising interhinged ring parts and assigned an activation means, such as a hydraulic piston cylinder. The catcher means per se, which possibly may be made as a replacable device, is shaped and designed for adaption to the object to be lifted and hoisted up from its position downhole in the ground. Alternatively, the device may be used to urge e.g. a pipe down into a predrilled bore hole.

This catcher means is disposed on a first carriage adapted to the two guidances on the derrick of the drilling rig for the carriage of the drilling machine—in the following called the second carriage. First carriage will constitute bottom carriage and second carriage top carriage.

The most important feature of the method according to the present invention consists in that the first (bottom; lower) carriage with the hauling-up device is permanently coupled to a driven motion transferring mechanism adapted to effect rectilinear, reciprocating displacement movements of the hauling-up device in the derrick, the second (top; upper) carriage to which the drilling machine is coupled, in a first condition of the rig is coupled to the derrick, such that the first carriage with the hauling-up device alone can be displaced by means of the driven motion transferring mechanism during the hauling up of e.g. a casing, and that the second carriage, in a second condition of the rig is uncoupled from the derrick and, thereafter, is interconnected to the first carriage for common reciprocating displacement movements by means of the same motion transferring mechanism, which is driven by one single power source.

A drilling rig comprising a derrick having guidances for said upper (second) carriage carrying a drilling machine is, in accordance with the present invention, provided with said lower (first) carriage disposed below the upper carriage, guided in the guidances of the derrick and carrying said hauling-up device adapted for reciprocating displacement movements by means of said motion transferring mechanism and carrying said catcher means in the form of a grab, a clamp, a clip or similar claw or jaw means adapted to securely grasp e.g. a casing situated in a bore hole in the earth, in order to being able to haul the casing up and park it, the catcher means releasing the casing upon the parking thereof. According to the invention, said rig further distinguishes itself through exhibiting means for interconnecting the upper carriage and the lower carriage (when the upper carriage with the drilling machine has been uncoupled from the derrick) so that the drilling machine and the hauling-up device can be displaced to and fro jointly by means of the driven motion transferring mechanism, and means for interconnecting the upper carriage with the drilling machine and the derrick (thereby making the upper carriage stationary), simultaneously as the first-mentioned means uncouples the upper carriage from the lower carriage, which is connected to said driven motion transferring mechanism and which, in this condition, can be reciprocated alone, i.e. during the hauling-up operations.

Said interconnecting means may advantageously have the form of piston cylinders carried by the upper carriage carrying the drilling machine, and wherein each piston rod end portion is extendable beyond the end of the associated hydraulic cylinder, each cooperating with through-going locking holes, one locking hole in the derrick and one locking hole in the lower carriage carrying the hauling-up device. Each of double-acting plunger cylinders contain the real piston which constitutes a thickening on the plunger, each cylinder being assigned two ports alternately acting as inlet for the supply of hydraulic liquid to the respective cylinder chamber below/above the piston and as outlet/return port for hydraulic liquid from the outer and inner cylinder chamber, respectively.

The ports of the two plunger cylinders, each alternately acting as supply/return port, may, using hoses/pipelines, a hydraulic pump and a multiple-way valve, be coupled such that the port of one cylinder passing to the cylinder chamber for extending the plunger end portion is coupled to the other cylinder's port passing to the cylinder chamber for pulling in said plunger end portion, the other ports of the cylinders also being interconnected in such a way that extension of one plunger end portion into engagement with e.g. the locking hole in the derrick compulsorily causes withdrawal of the other plunger end portion which was in engagement with the locking hole of the lower carriage, and vice versa. Thus, such a compulsory guidance of the end portions of the two plungers makes sure that the upper carriage is not interconnected with the lower carriage for reciprocating movements therewith simultaneously as the upper carriage carrying the drilling machine is connected to the derrick.

In one embodiment, such driven motion transferring mechanism may consist of an endless chain passed around two turning sprockets, one at each of the two opposite transitions between the parallel portions of the chain. The drive source may e.g. consist of a hydraulic turning motor the outgoing shaft thereof carrying a sprocket meshing drivingly with the chain. Alternatively, the drive/transmission mechanism may consist of a combination of a hydraulic piston cylinder and a chain passed around sprockets with a view of achieving an increased force during the extension.

BRIEF DESCRIPTION OF THE DRAWINGS

Further objects, advantages and features of method and device according to the invention will appear from the following description with reference to accompanying drawings, wherein.

DETAILED DESCRIPTION OF THE INVENTION

Figure 3:
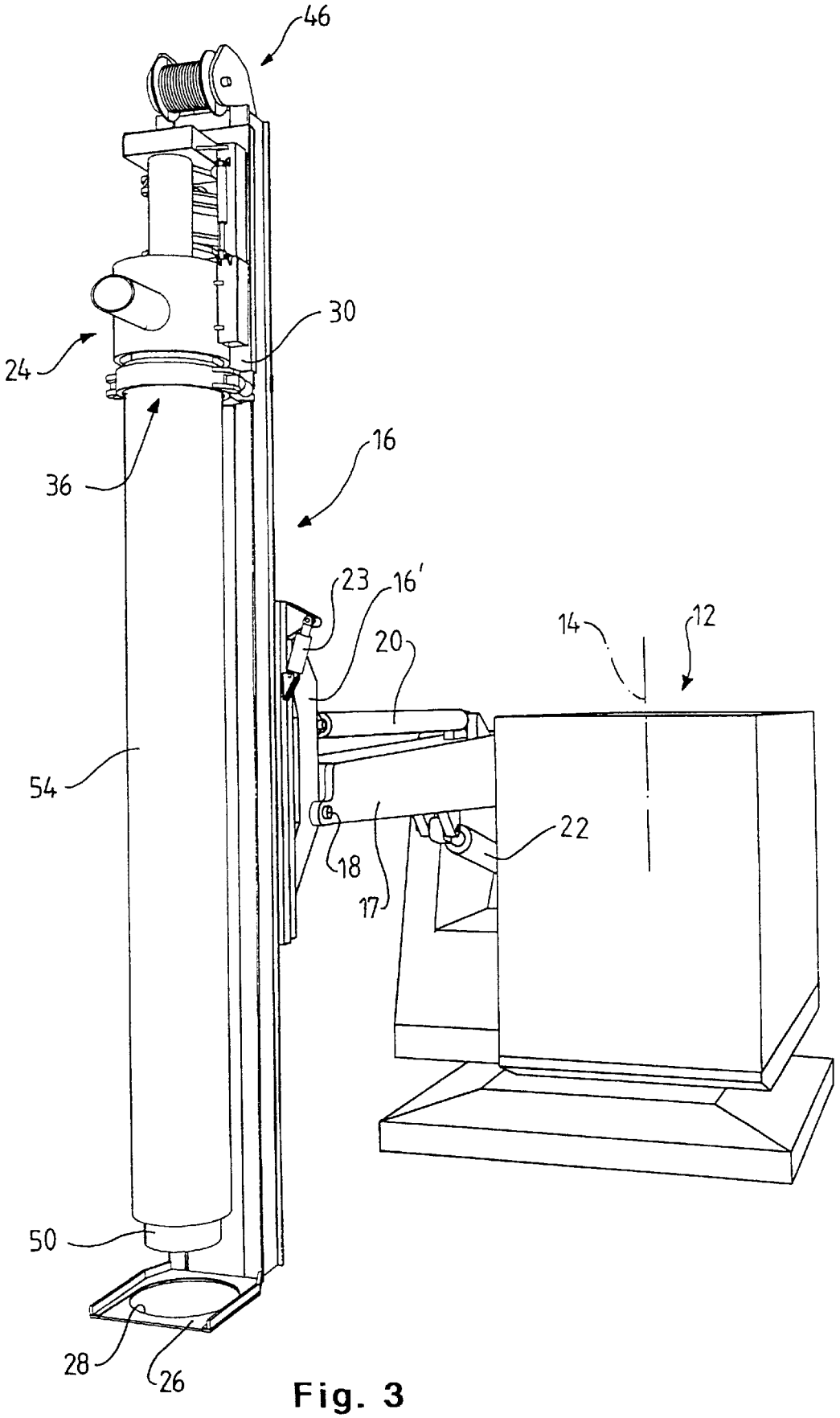
FIG. 3 corresponds to FIG. 1, but it shows the upper and lower carriage in an interconnected condition and, moreover, illustrates a casing and a narrower, internal, concentric pipe which, together with the casing, is used during the drilling operations, without the bit.
Figure 4:
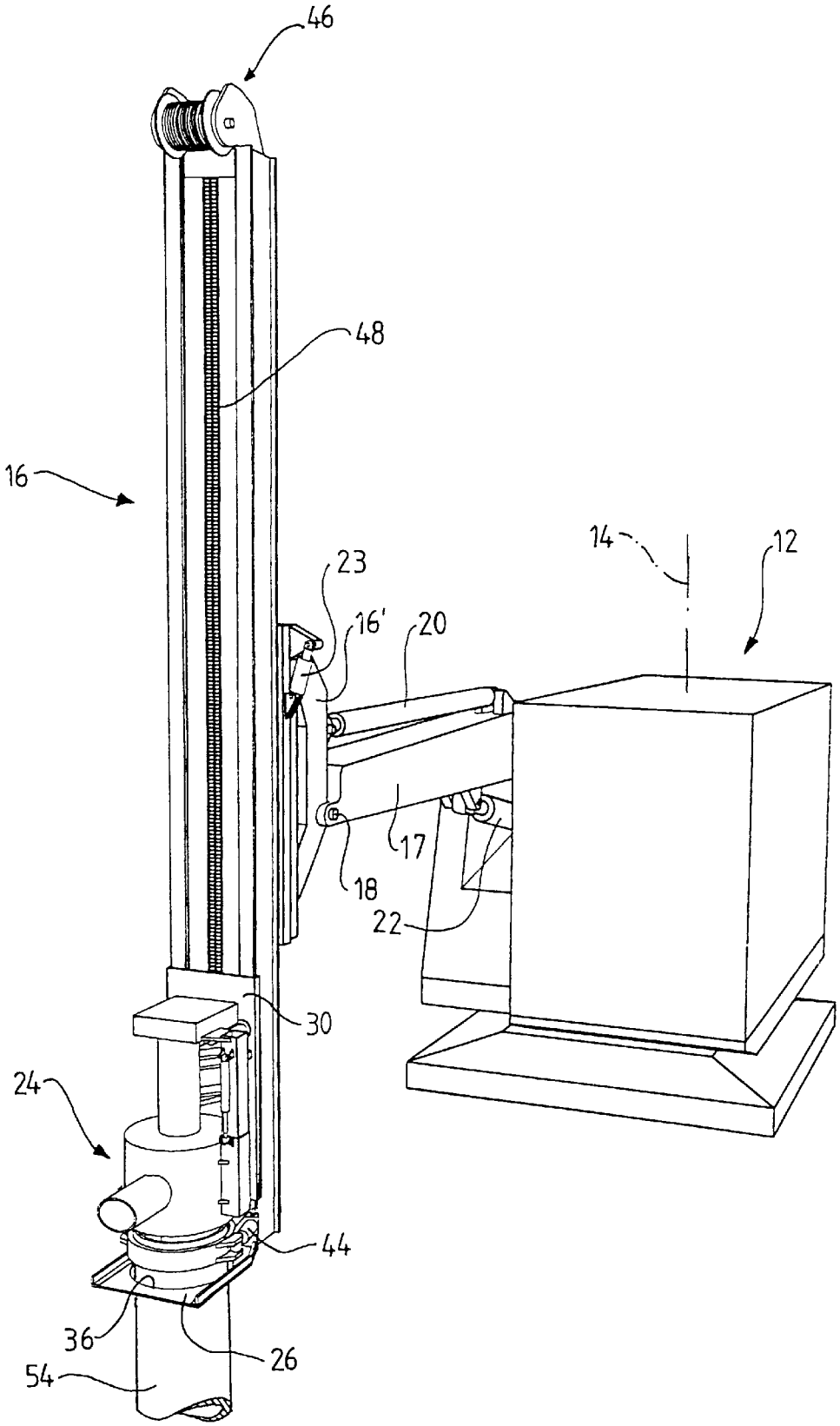
FIG. 4 shows a perspective view of the drilling rig where the interconnected carriages for drilling machine and hauling-up device, respectively, occupy a lower position, in which the casing has been placed in a hole drilled in the ground.

When drilling a hole in the ground in order to cast an underground tubular base or in order to effect piling from the bottom of the bore hole, a casing is disposed such that it follows the drilling machine in the downwardly directed movement thereof as the drilling proceeds, said casing being left standing on the bottom of the bore hole upon the conclusion of the latter, whereafter the drill string with the bit is pulled up. When the tubular base, the base pipe, has been placed in the bore hole, it is desired to withdraw the casing upwards for reuse. Now, the drilling machine's carriage (the upper carriage) which up to now has been coupled to the casing hauling-up device's carriage (the lower carriage), is coupled to the derrick, while the catcher means of the hauling-up device is brought to grip and surround the upper end portion of the casing, whereafter the casing is hauled up. If the previously mentioned inner pipe, which during drilling forms a narrow annulus with the casing, still is suspended from the chuck of the drilling machine (FIGS. 3 and 5), the drilling machine with the inner pipe is swung laterally aside, in order to prevent that the inner pipe shall interfere with the casing hauling-up operation.

In the drawings, reference numeral 10 generally denotes a drilling rig, the drive aggregate 12 thereof being rotatable 360° about a vertical axis 14. A derrick 16 is, through a turnable attachment frame 16', pivotally suspended from the drive aggregate 12 through a boom 17 about a horizontal axis 18, around which the derrick 16 can be pivoted by means of a hydraulic piston cylinder 20. The boom 17 can be moved in the vertical plane by means of a hydraulic piston cylinder 22. The derrick 16 together with the drilling machine 24 can be turned in relation to the attachment frame 16' by means of hydraulic piston cylinders 23, 23'.

Below, the derrick 16 is defined by a projecting plate 26 having a guiding hole 28 for a casing, not shown.

Figure 1:
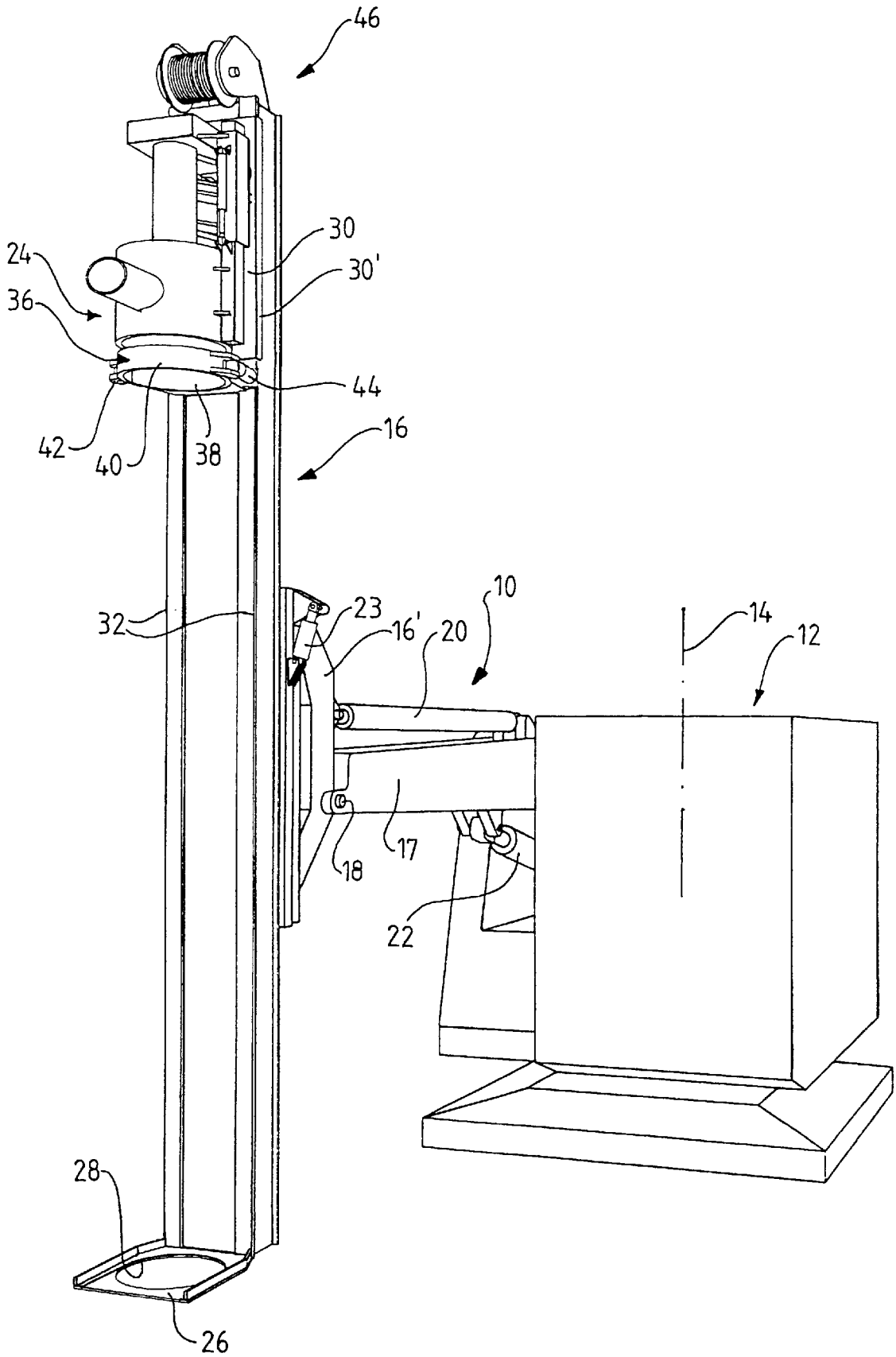
FIG. 1 shows in a perspective view a drilling rig where the carriage for the drilling machine is coupled to the lower carriage, as seen obliquely from ahead.
Figure 2:
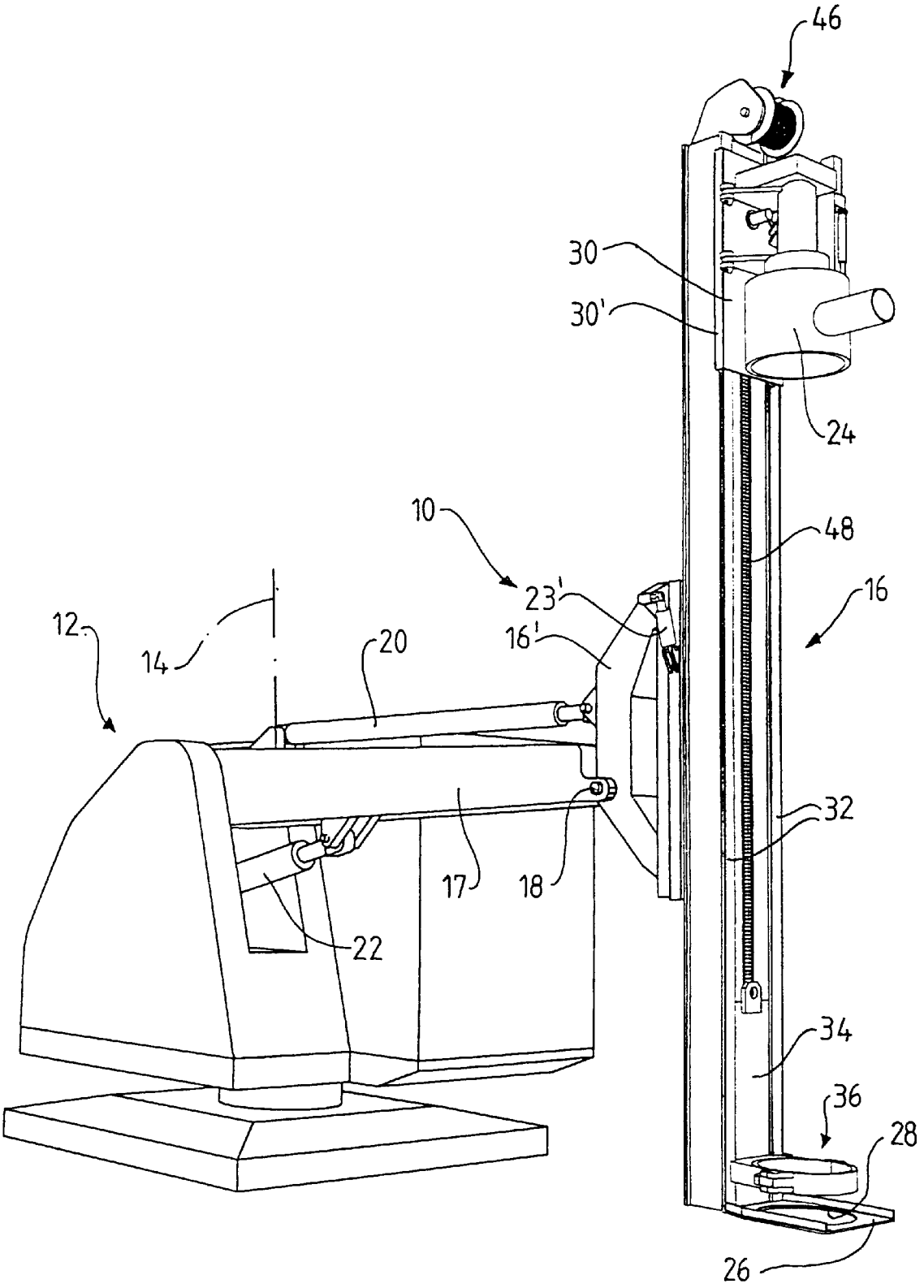
FIG. 2 shows the drilling rig in a position wherein the lower carriage with the hauling-up device is uncoupled from the upper carriage with the drilling machine, and where the latter is interconnected with the derrick in an upper position, the lower carriage with the hauling-up device taking a lower position.
Figure 10:
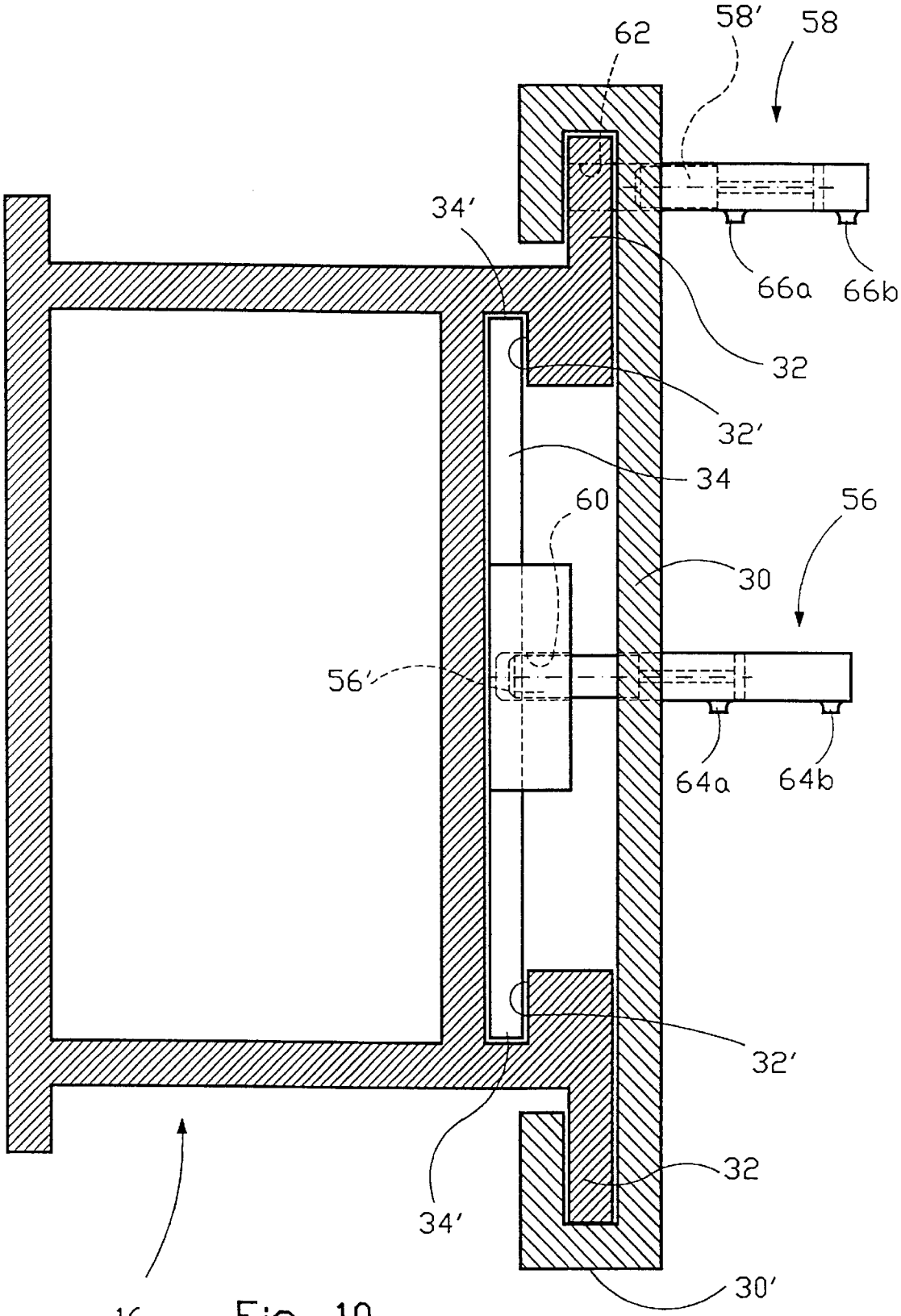
FIGS. 10 and 11 show horizontal sections in the area XI in FIG. 7, FIG. 10 showing how the two carriages are interconnected, the upper carriage compulsorily being uncoupled from the derrick, while FIG. 11 corresponding to the section plane XI shows how the upper carriage with the drilling machine is coupled to the derrick, simultaneously as the upper carriage compulsorily is uncoupled from the lower carriage.

The drilling machine 24 is carried by an upper carriage 30, see FIGS. 2 and 10, U-shaped guide edge portions 30' thereof engaging displaceably around the derrick's 16 longitudinal guidance edges 32 which, for the purpose of guiding, likewise may have a horizontal U-shaped cross-section, in respect of a lower carriage 34 the vertical edges 34' thereof engaging displaceably into said U-shaped guidance edges 32'.

Figure 8:
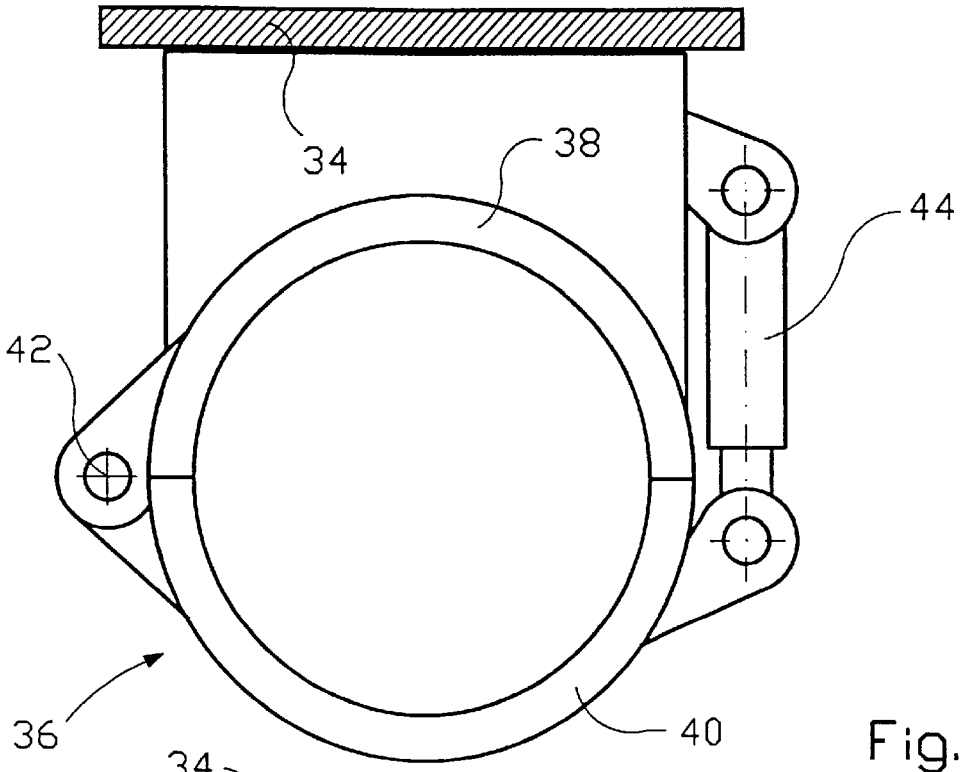
FIG. 8 shows a top plan view of the catcher means or clip of the hauling-up device in a closed gripping position.
Figure 9:
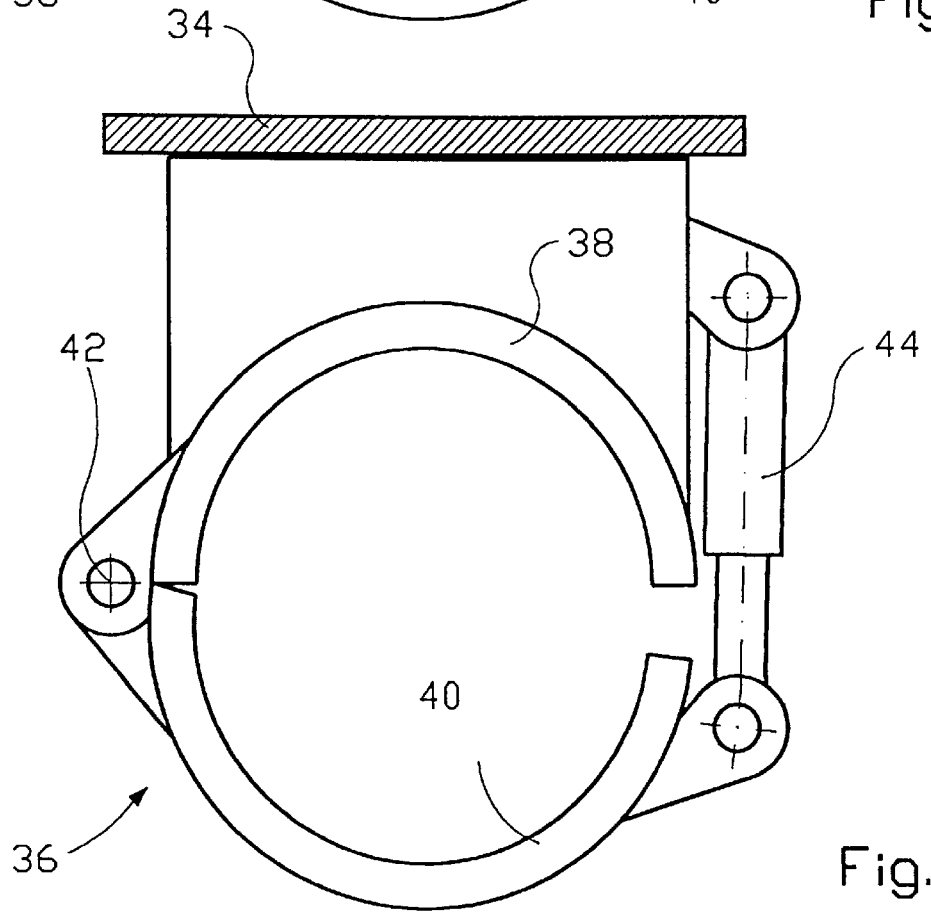
FIG. 9 shows the same catcher means in an open position.

The lower carriage 34 carries a catcher means in the form of a clamp or clip, generally denoted at 36. The clip 36 which appears clearest from FIGS. 8 and 9 on a relatively large scale, has a fixed jaw 38 and a movable jaw 40 hinged thereto and pivotable about the vertical axis 42 of the hinge, a double-acting hydraulic piston cylinder 44 turning the movable jaw 40 between a closed catching position, FIG. 8, and a more or less open position of readiness/release position taken by the clip when it, from above, is threaded down onto the upper end portion of a casing, FIG. 9.

On the top of the derrick 16, a small winch 46 is disposed, the winch i.a. being used for easing a base pipe (a tubular base) down into the bore hole.

Figure 7:
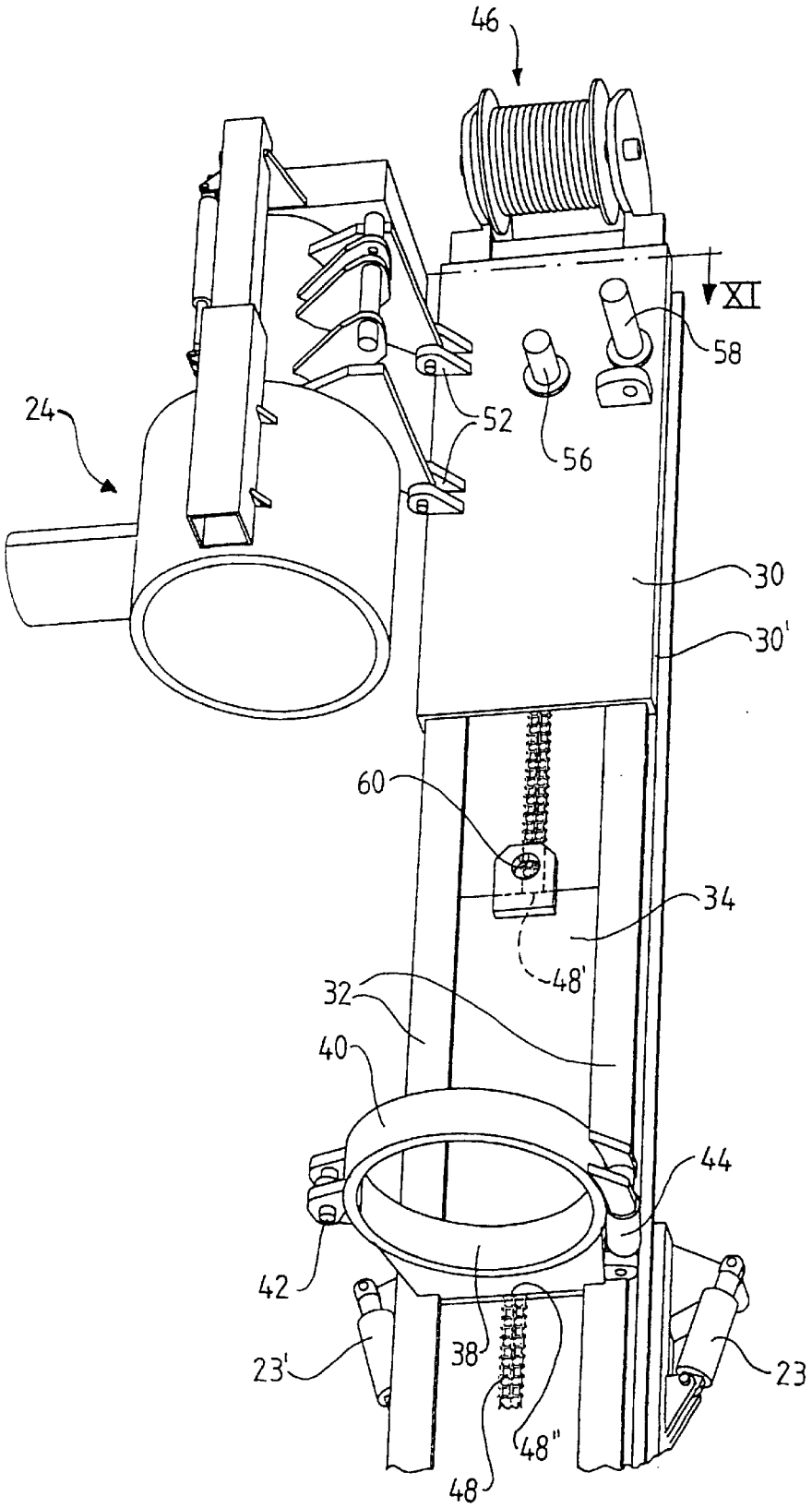
FIG. 7 shows a perspective view of the drilling rig, seen obliquely from below, where the drilling machine has been swung laterally, out of the way, so that the upper carriage, which is coupled to the derrick, exhibits the two plunger cylinders serving as coupling means between the upper carriage and the derrick on the one hand and the upper carriage and the lower carriage on the other hand.

The lower carriage and, thus, the hauling-up device's catcher means in the form of the clip 36, are permanently attached to a driven motion transmission device which, in the embodiment shown, has the form of a driven endless chain 48, see e.g. FIG. 7, which has been placed around turning sprockets, not shown, and which is driven by a sprocket, not shown, in engagement with the chain 48 and carried by the outgoing shaft of a hydraulic motor, not shown. The turning sprockets, not shown, for the chain 48 are both rotatably suspended from the derrick, one turning sprocket in an uppermost position in the derrick 16, one turning sprocket at the lowermost end of the derrick, assigned thereto horizontal rotational axes, as well as being positioned such that the two longitudinal portions of the chain are substantially parallel to the derrick 16. The two ends 48' and 48" are attached to the lower carriage 34, at the upper and lower portions thereof, respectively.

As mentioned above, the upper carriage 30 is adapted to be coupled temporarily to the derrick 16, while the lower carriage 34 carrying the catcher means 36, by means of the chain 48, is displaced down within the bore hole, in order to fetch a casing used in a preceding operation, said casing now being hauled up for reuse. The clip 36 is eased off and brought to catch surroundingly around the casing's upper end portion, which projects up through the casing guidance 26, 28.

With the casing suspended from the clip 36, the chain 48 is activated for upward movement, thus pulling the casing up from its lowermost position within the bore hole. Alternatively, the lower carriage 34 carrying the catcher means 36 may be used to lower or urge a pipe down into a predrilled hole.

The upper carriage 30 is equipped with hinges 52 having a vertical axis along one vertical side edge 30'. The drilling machine 24 is hinged to the upper carriage 30 and can be turned between a normal position where it occupies a central position in front of the upper carriage, e.g. as shown in FIGS. 1–4, and a position swung laterally aside from the front side of the upper carriage and of the derrick, respectively, e.g. as shown in FIGS. 5 and 7.

Figure 5:
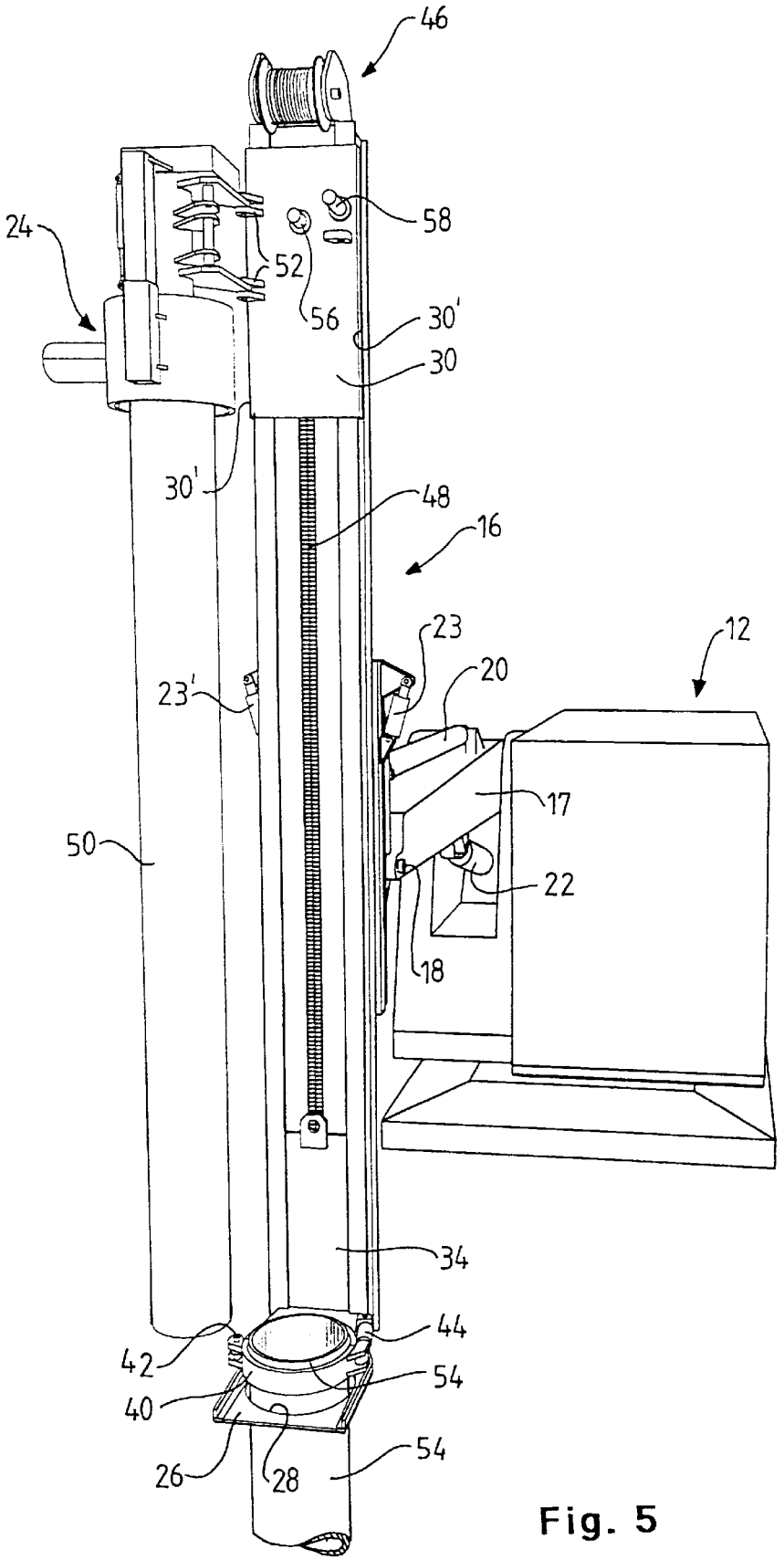
FIG. 5 shows a perspective view of the drilling rig when the drilling machine has hauled said narrower inner pipe entirely up, the carriage for the drilling machine occupying the uppermost position, simultaneously as the drilling machine with the inner pipe is swung laterally about hinges having a vertical axis and positioned along one of the vertical side edge of the upper carriage , so that the lower carriage carrying the hauling-up device is uncoupled from the upper carriage which is coupled to the derrick and carries the drilling machine, and where the lower carriage carrying the hauling-up device can be moved downwards and upwards without said inner pipe interfering with the rectilinear movement path thereof.
Figure 6:
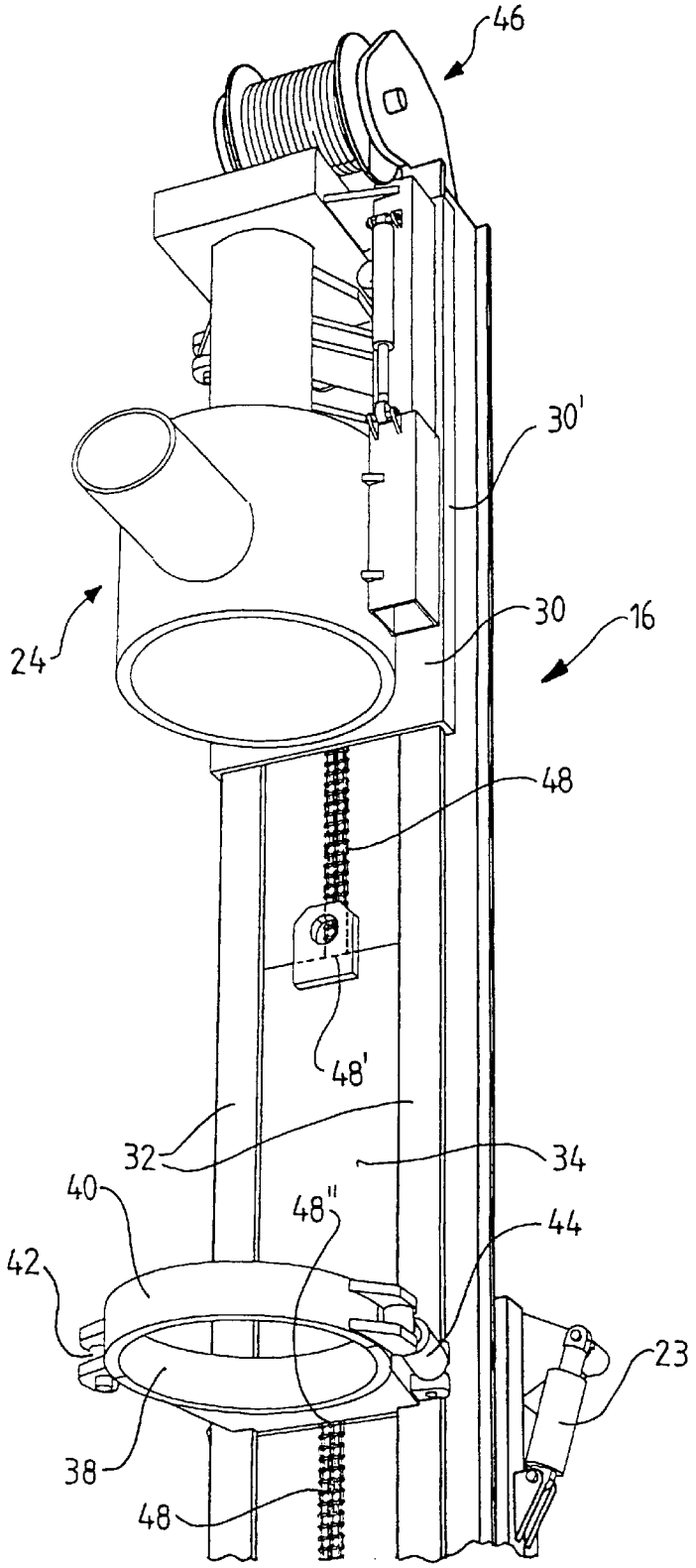
FIG. 6 shows a perspective view on a somewhat larger scale, seen obliquely from below, where the displacing means, the catcher means and the lower carriage of the hauling-up device appear, the upper carriage with the drilling machine occupying the upper position, coupled to the derrick, and in a swung-in position in relation to FIG. 5.

In FIG. 5, a casing 54 is shown , the clip 36 keeping it firmly at the upper end portion thereof. From this figure, it appears that the two carriages 30, 34 are uncoupled from each other, the upper carriage 30 being coupled to the derrick 16, so that the lower carriage 34 carrying the clip 36 of the hauling-up device may effect the casing hauling-up operation. Likewise, the carriage 30 of the drilling machine may be coupled to the derrick in a normal position, i.e. without having been turned laterally aside, see e.g. FIG. 6. As previously mentioned, the upper and lower carriages have to be interconnected during drilling operations and, possibly, during piling operations, so that the upper carriage carrying the drilling machine is displaced downwardly and upwardly by means of the driven chain 48 permanently coupled to the lower carriage 34. In this way, one can carry out both hauling-up operations, drilling operations and insertion operations in underground bore holes with a common driven motion transmission mechanism.

The upper carriage 30 carrying the drilling machine 24 is coupled to the lower carriage 34 carrying the clip 36 of the hauling-up device when drilling operations are to be carried out and is coupled to the derrick 16 and uncoupled from the lower carriage 34 when hauling/up and downwardly directed insertion operations, respectively, are to be carried out. It should, without saying, be clear that the upper carriage 30 either must be coupled to the lower carriage or to the derrick 16. Thus, the upper carriage can under no circumstances be coupled both to the lower carriage and to the derrick.

A suitable device for effecting these interconnections, excluding the possibility of interconnecting the upper carriage, the lower carriage and the derrick simultaneously, appears from FIGS. 5, 7, 10 and 11.

The upper carriage 30 carries two double-acting plunger cylinders 56 and 58. Each of these plunger cylinders 56 and 58 has an internal piston carried by a piston rod 56', 58' extendable beyond the adjacent end face of the respective cylinder 56 and 58, respectively. These extendable piston rods 56', 58' may be brought into engagement with a locking hole 60 in the lower carriage 34 and with a locking hole 62 in the derrick 16, respectively.

Each of the two double-acting plunger cylinders 56 and 58 on the upper carriage 30 carrying the drilling machine, has two ports **64*a*, 64*b* and 66*a*, 66*b*, respectively, the various ports changing between constituting the inlet and the outlet. The hydraulic system comprises, besides hoses/pipelines coupled to the connecting branches surrounding the ports 64*a*, 64*b*, 66*a* and 66*b*, also a hydraulic pump assigned an operating means and a multi-way valve (not shown). Then, the connecting branch of the port 64*a* is coupled to the connecting branch of the port 66*b*, the connecting branch of the port 64*b* being coupled to the connecting branch of the port 66*a*. Such a cross coupling makes it impossible for the upper carriage 30 to be coupled to the lower carriage 34 and to the derrick 16 simultaneously. When a locking portion of the plunger, e.g. 56', from the position of FIG. 11, is pushed into the locking hole 60 of the lower carriage 34, as shown in FIG. 10, the locking portion 58' of the plunger associated therewith, simultaneously, because of the port's 64***b* interconnection to the port 66*a*, is compulsorily pulled out from the hole 62 of the derrick 16, the positions shown in FIG. 10 then being established.

Figure 11:
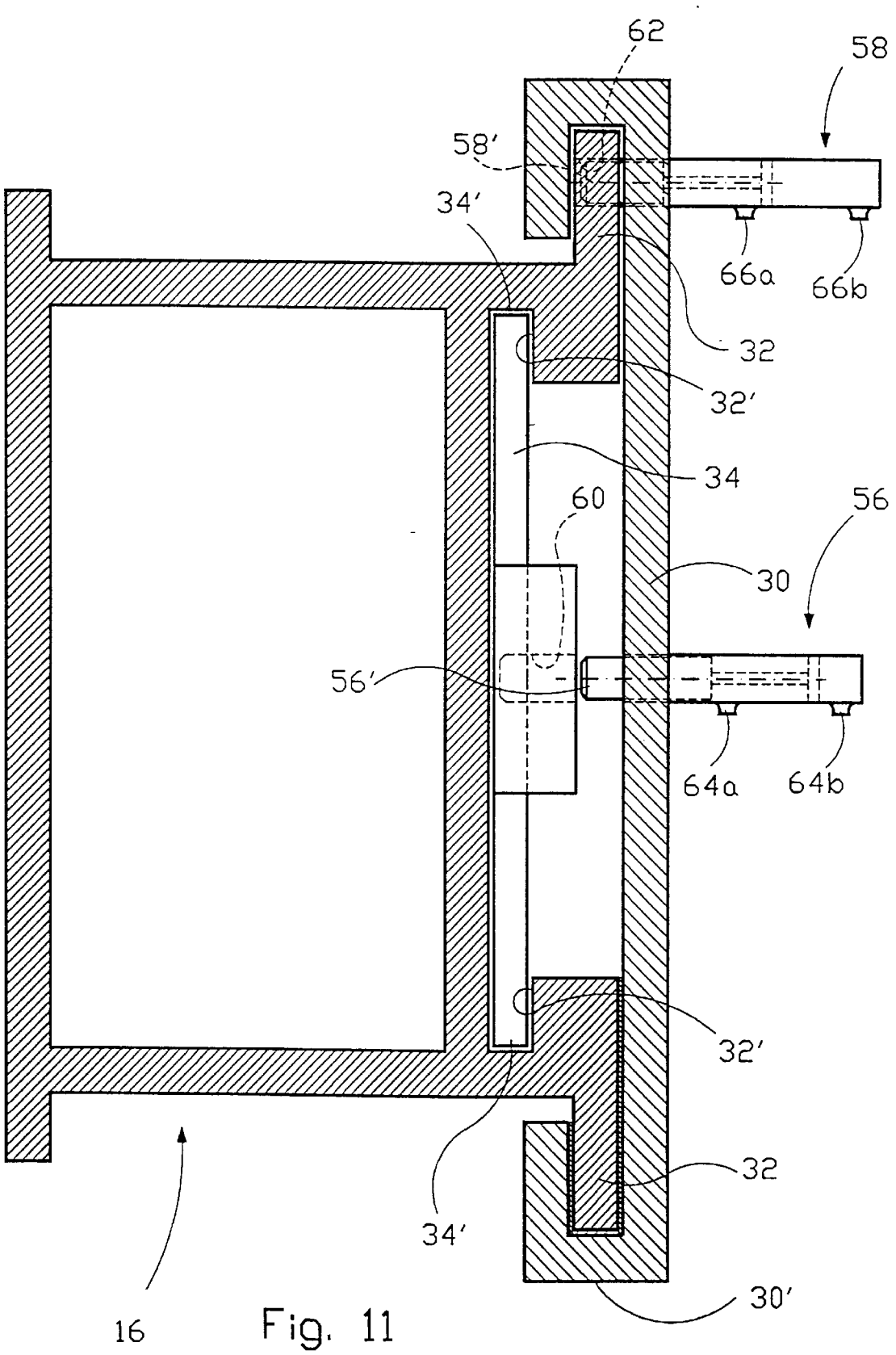

When the locking portion 58', from the position in FIG. 10, is to be pushed into the locking hole 62 of the derrick 16, as shown in FIG. 11, hydraulic liquid is supplied to the port 66*b*, whereby hydraulic liquid simultaneously and compulsorily is supplied to the other plunger cylinder's 56 port 64*a*, effecting withdrawal of the locking portion 56' into the cylinder 56 and pulling the locking portion 56' out from the locking hole 60 of the lower carriage 34, so that the upper carriage 30 carrying the drilling machine 24 is locked to the derrick 16, simultaneously as the lower carriage 34 carrying the clip 36 of the hauling-up device is released from the upper carriage, whereby the positions shown in FIG. 11 for the upper and lower carriages are established.

What is claimed is:

1. A method for hauling up and lowering, respectively, a pipe in a bore hole in connection with drilling operations carried out by a drilling rig having a first, upper carriage with a drilling machine coupled thereto, the drilling machine being displaceably disposed along a derrick of the drilling rig, which is equipped with a driven transmission mechanism for rectilinear, reciprocating displacement movements, the method comprising the steps of:

coupling a second, lower carriage to the driven transmission mechanism and guiding said lower carriage along the derrick, the lower carriage including catching means;

coupling said upper carriage to the derrick, while the lower carriage is oriented by the derrick for alignment in relation to an upper end of the pipe;

grabbing the upper end of the pipe with the catching means of the lower carriage;

activating the driven transmission mechanism in order to effect displacement of said second carriage holding the pipe with the catching means until the pipe has been hauled up the bore hole or lowered down the bore hole, respectively;

uncoupling the drilling machine from the derrick and coupling the drilling machine to the lower carriage; and jointly displacing the drilling machine and the catching means down and up with the driven transmission mechanism during the drilling operations wherein, the driven transmission mechanism being operative as a drive device for reciprocating movements at the drilling, hauling-up, and lowering operations carried out from the rig.

2. A method as set forth in claim 1, wherein the upper carriage includes hinges which define a vertical axis therethrough and further comprising the step of turning the drilling machine aside about the vertical axis of the upper carriage if equipment is suspended therefrom when the pipe is to be hauled up or lowered in the bore.

3. An arrangement in a drilling rig having a derrick, along which a drilling machine is displaceably disposed on a first, upper carriage by a driven transmission mechanism for transferring rectilinear reciprocating displacement movements, comprising:

catching means for grabbing one end of an object to be driven down into the ground;

a second, lower carriage for carrying the catching means, the second, lower carriage disposed for reciprocating displacement along the derrick, said second, lower carriage being permanently coupled to said driven transmission mechanism in order to haul the object held by the catching means up or lower the object held by the catching means down, respectively, by the driven transmission mechanism through the second, lower carriage;

coupling means for interconnecting the first, upper carriage and the derrick while hauling-up or lowering operations are taking place and interconnecting the first, upper carriage and second, lower carriage when drilling operations are to be carried out, said derrick including a lowermost section having a right angledly projecting, plate-shaped means having an aperture, the diameter thereof exceeding the diameter of the object and serving as a guide upon relative movements between the upper end portion of the object and the catching means, the driven transmission for transferring rectilinear reciprocating displacement movements includes a driven, endless chain attached to said second, lower carriage and extending along substantially the entire length of the derrick, the catching means includes a fixed jaw and a pivoting jaw interhinged thereto, the pivoting jaw being moveable relative to the fixed jaw by a hydraulic piston cylinder, and wherein the coupling means comprises first and second coupling means, the first and second coupling means being carried by said first, upper carriage to which the drilling machine is attached, one of said first and second coupling means being adapted to couple the first, upper carriage to the second, lower carriage, the other coupling means being adapted to couple the first, upper carriage to the derrick, allowing the second, lower carriage and the catching means to operate independently of the drilling machine, said first and second coupling means being mutually interconnected so that only one of said first and second coupling means can be operative at a time.

4. An arrangement as set forth in claim 3, wherein the first and second coupling means respectively include first and second double-acting piston cylinders, each one of the first and second piston cylinders having a piston rod with a locking portion that is extendable from and withdrawable into its corresponding cylinder, and wherein the derrick and the second, lower carriage each include a locking hole for temporary cooperation with a respective one of the piston rod locking portions, said locking portions upon engagement in individually assigned ones of the locking holes, locks the first, upper carriage to one of the derrick and the second, lower carriage, the first and second double-acting piston cylinders being interconnected so that the locking portion of only one of the first and second piston cylinders can be in engagement with its assigned locking hole at any given time.

5. An arrangement as set forth in claim 4, wherein each of the first and second double-acting piston cylinders include two ports and associated connecting branches for supplying and returning hydraulic liquid, the ports and associated connecting branches of the first and second piston cylinders coupled within a hydraulic circuitry which includes a pump and a multi-way valve, wherein one of the ports of the first piston cylinder is for supplying hydraulic pressurized liquid in order to extend the piston rod locking portion of the first piston cylinder into engagement with its corresponding locking hole of the lower carriage, said one port of the first piston cylinder being interconnected to one of the ports of the second piston cylinder for supplying hydraulic pressurized liquid in order to cause withdrawal of the piston rod locking portion of the second piston cylinder into its cylinder, thereby pulling the piston rod locking portion of the second piston cylinder out from its associated locking hole of the derrick, the first piston cylinder's other port for supplying hydraulic pressurized liquid in order to cause withdrawal of its piston rod locking portion out of engagement with the second piston cylinder's other port for supplying hydraulic pressurized liquid in order to extend its associated piston rod locking portion into engagement with its corresponding locking hole of the derrick.

* * * * *